United States Patent [19]

Stewart

[11] 4,218,801

[45] Aug. 26, 1980

[54] FILM GUIDE FOR USE WITH FILM CLEANING APPARATUS

[75] Inventor: James F. Stewart, Shorewood, Minn.

[73] Assignee: Pako Corporation, Minneapolis, Minn.

[21] Appl. No.: 53,091

[22] Filed: Jun. 28, 1979

[51] Int. Cl.[3] ..... B08B 11/00

[52] U.S. Cl. ..... 15/100; 246/76; 352/224; 354/339

[58] Field of Search ..... 15/77, 100, 102; 352/221, 224; 246/76; 226/196; 354/339

[56] References Cited

U.S. PATENT DOCUMENTS

| | | | |
|---|---|---|---|
| 2,073,287 | 3/1937 | Sandvik | 15/100 X |
| 2,608,357 | 8/1952 | Brearton | 242/76 |
| 3,644,953 | 2/1972 | Christiansen | 15/100 |
| 4,081,815 | 3/1978 | Horner | 354/339 |

FOREIGN PATENT DOCUMENTS

| | | | |
|---|---|---|---|
| 1282870 | 12/1961 | France | 354/339 |

*Primary Examiner*—Edward L. Roberts
*Attorney, Agent, or Firm*—Kinney, Lange, Braddock, Westman and Fairbairn

[57] ABSTRACT

A film cleaning apparatus for cleaning the photographic film prior to printing includes special guides which permit the film cleaning apparatus to be used with both first-run production and tabbed reprint production. The film cleaning apparatus is of the type having a pair of support members in opposed relationship which define a nip which is disposed transverse to the path of the photographic film. Two lengths of soft, lint-free wiping cloth extend through the nip with the opposed surfaces of the cloth at the nip defining a part of the path. The guide includes first and second generally parallel guide plates having opposing surfaces defining an opening which is part of the path. The opening defined by the guide plates has an inlet end and an outlet end, and the plates are in fixed position with respect to the film cleaning apparatus with the outlet end of the opening proximate the nip. A first member is positioned forward and above the inlet end of the opening for guiding film downward toward the inlet end, and a second member is positioned forward and below the inlet end for guiding film upward toward the inlet end. The film guide, therefore, permits reliable feeding and guiding of short film segments attached to a paper tab like those used in photographic reprint systems.

18 Claims, 5 Drawing Figures

FILM GUIDE FOR USE WITH FILM CLEANING APPARATUS

BACKGROUND OF THE INVENTION

1. Field of the Invention

The present invention relates to photographic printing systems. In particular, the present invention is an improved film guiding apparatus used in conjunction with film cleaning apparatus to permit the film cleaning apparatus to be used both for first-run and photographic reprint production.

2. Description of the Prior Art

In commercial photographic processing operations, very high rates of processing must be achieved and maintained in order to operate profitably. In order to permit efficient automatic processing, orders containing films of similar type and size are typically spliced together for developing. As many as 500 to 1,000 rolls of twelve, twenty, twenty-four and thirty-six exposure film of the same type and size may be spliced together for processing and printing purposes.

After developing the photographic images contained in the film originals (generally negatives) are printed in an edge-to-edge relationship on a continuous strip of photosensitive paper by a photographic printer. The photographic printer causes high intensity light to be passed through the negative and imaged on the photographic print paper to expose the photographic emulsion layers of the paper. The print paper is subsequently processed to produce a print of the image contained in the negative.

The type of large-scale production is well suited to original or first-run production of photographic prints in which the film may be spliced to form a continuous roll. In the past, however, it has not been particularly well suited to production of reprints, where the customer has already received prints and has decided that he wishes to have additional prints made of certain negatives. Unlike first-run productions, making of reprints has typically not been highly automated.

There are several reasons why reprints require special, less efficient handling. First, when reprints are ordered, the negatives generally have already been cut into short segments of three or four frames each, which are more difficult to handle than the longer film strips encountered in first-run production printing. Second, the customer may only desire reprints from one frame of a particular segment. This is unlike first-run production in which a print is typically made from every printable negative on the strip. Third, often multiple prints rather than just a single print are desired from one or more negatives on a segment. Fourth, no extra non-printing area on the film is normally available to which a splice may be made. Fifth, reprints are requested from a much wider variety of film types than are typically encountered in first-run production. This is because most first-run production involves recently purchased and exposed film, while reprints may be from films which were purchased many months or even years earlier.

Because of these problems, making of reprints has often been handled on a manual or semi-automatic basis, and often on a different printer from the high speed first-run production printers on which it may be impossible to reproduce identical print color balance. As a result, the quality of reprints often differs from first-run production prints. The lower quality of reprints in comparison to first-run production prints is a source of customer dissatisfaction.

In order to overcome some of the problems of making reprints, and to provide more efficient automated printing of reprints, systems have been developed in which the individual segments of negatives (usually three or four frames each) from which reprints are to be made are temporarily attached to a long paper strip or "tab". While the "tabbing" of short film segments permits automated handling of reprints on a high speed printer, it has also presented some unique problems which are not present with first-run production. One of these problems is the fact that the film segments are attached to the paper tab only along one edge. As a result, the opposite edge of the film segment is uncontrolled, and has a tendency to get caught and cause jamming of the paper tab and film.

In many photographic printers used for first-run production printing, film cleaning apparatus is provided which removes fine dust and other foreign materials from the photographic film prior to printing of that film. Since photographic films are dielectric materials, there is a tendency for static electric charges to be developed on their surfaces during handling. These static electric charges tend to attract dust to the film surfaces. If this dust is not removed prior to the printing, the dust particles of the negative may appear as imperfections in the resulting print. One particularly successful type of film cleaning device is the 3M Film Cleaner sold by Minnesota Mining and Manufacturing Company. U.S. Pat. No. 3,644,953 by Christiansen describes a film cleaning apparatus of this type, which has a pair of support members in opposed relationship which define a nip. Two lengths of soft, lint-free wiping cloth extend through the nip and form a part of the path of the film through the film cleaner. In addition, a nuclear ionizing device is typically provided to ionize the air along the path and neutralize static electric charges on the film.

It is equally important to provide film cleaning of the film segments attached to a paper tab in a photographic reprint system. Difficulties have been encountered, however, when attempts have been made to use conventional film cleaning apparatus in photographic reprint systems. The short film segments which are attached to the tab along only one edge have presented problems in feeding through the conventional film cleaning apparatus. The "tabbed" film segments have tended to cause jamming, tearing of the tab, or separating of the film segments from the tab.

SUMMARY OF THE INVENTION

The present invention is a unique guiding system for guiding photographic film into photographic film cleaning apparatus of the type having a pair of support rollers in opposed relationship which define a nip which is disposed parallel to the path of the film, and which have two lengths of soft, lint-free wiping cloth extending through the nip to clean the film as it passes through the nip. The guide of the present invention permits both first-run production film strips which are spliced together, and tabbed reprint film segments to be cleaned using the same film cleaning apparatus.

The film guide of the present invention includes first and second generally parallel, closely spaced guide plates. The opposing surfaces of the guide plates define an opening which is part of the film path. The opening has an inlet end and an outlet end, and the guide plates are in fixed position with respect to the film cleaning apparatus so that the outlet end is positioned proximate the nip. The film guide of the present invention also includes a first member which is positioned forward and above the inlet end and a second member which is positioned forward and below the inlet end of the opening. The first member guides the film downward toward the inlet end, while the second member guides the film upward toward the inlet end.

DETAILED DESCRIPTION OF PREFERRED EMBODIMENTS

Figure 1:
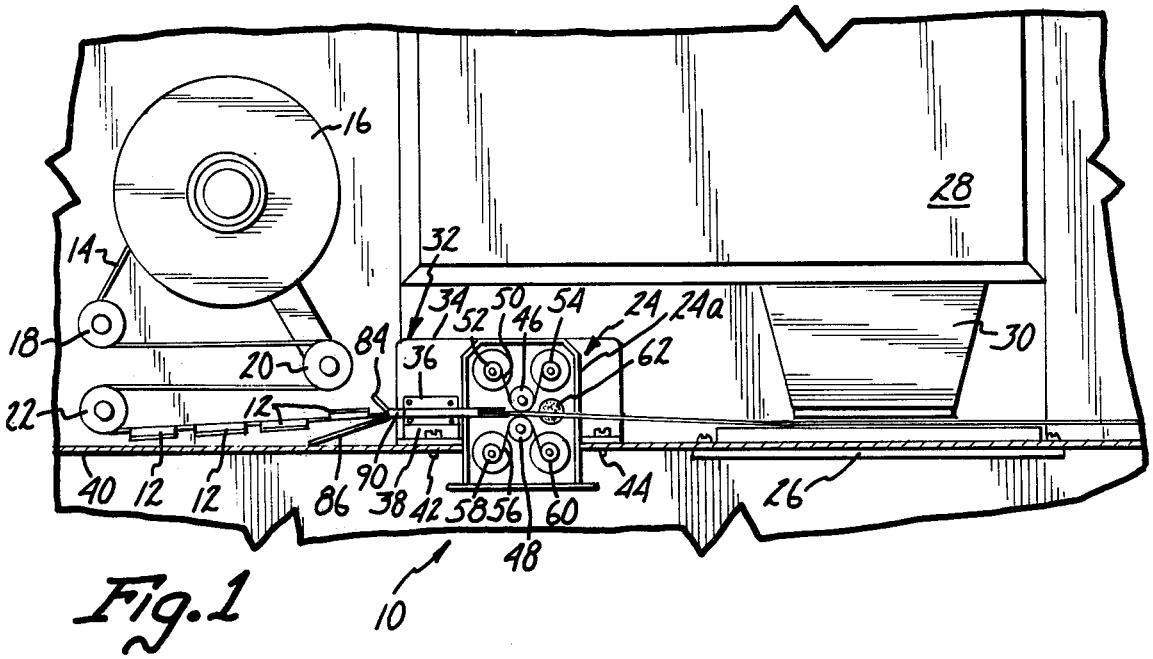
FIG. 1 is a partial sectional front view of a photographic printer having film cleaning apparatus and the film guide of the present invention.

FIG. 1 shows a photographic printer 10 which utilizes the present invention in producing reprints. Film segments 12, from which reprints are made, are attached to an elongated paper tab 14. Typically the attachment of film segments 12 to tab 14 is by means of top and bottom strips of adhesive tape, which connect segments 12 to tab 14 along one edge of segments 12. The opposite edges of segments 12 are unattached.

In printer 10 of FIG. 1, film segments 12 and paper tab 14 are supplied from supply reel 16 over stationary roller 18, bale arm roller 20, and stationary roller 22 to film cleaning apparatus 24. In the embodiment shown in the present invention, film cleaning apparatus 24 is a 3M Film Cleaner sold by Minnesota Mining and Manufacturing Company and is of the general type described in the previously mentioned Christiansen U.S. Pat. No. 3,644,953.

After cleaning film segments 12 and tab 14 are advanced to neghold assembly 26, at which the individual frames of each film segment 12 are initially previewed by light sensors to determine whether automatic exposure corrections are necessary. Each frame is then advanced to a print gate where light from lamp house 28 is passed downward through drop cone assembly 30, and through the negative frame to expose photosensitive print paper (not shown) located within printer 10. After film segments 12 and paper tab 14 have passed neghold station 26 they are advanced over another roller and bale arm assembly to a take-up reel (not shown in FIG. 1).

FIG. 1 also shows a preferred embodiment of guide assembly 32 of the present invention, which guides film segments 12 and tab 14 into film cleaning apparatus 24. Guide assembly 32 includes mounting bracket 34, film guide 36, and mounting block 38. Mounting bracket 34 is connected to top surface 40 of printer 10 by mounting screws 42 and 44, and is also connected to housing 24*a* of film cleaning apparatus 24 by mounting screws (not shown). Mounting block 38 is connected to mounting bracket 34, and film guide 36 is in turn connected to mounting block 38.

As shown in FIG. 1, film cleaning apparatus 24 extends through an opening in top surface 40 of printer 10 so that a portion of film cleaning apparatus 24 is below the plane of top surface 40. The remainder of film cleaning apparatus 24 extends above top surface 40 and is held in position by mounting bracket 34.

Film cleaning apparatus 24 includes a pair of oppositely disposed tubular support members 46 and 48 which preferably have flexible semi-cylindrical walls positioned in opposed relationship to each other to define a nip which is disposed transverse to the path of film segments 12 and tab 14 through film cleaning apparatus 24. A first length of soft, lint-free wiping cloth 50 is supplied from a supply roller 54, under tubular support member 46, to a take-up roller 52. Similarly, a second length of soft, lint-free wiping cloth 56 is supplied from supply roller 60 over tubular member 48 to take-up roller 58. As film segments 12 pass along the path through the nip, they are cleaned on opposite surfaces by cloth 50 and cloth 56. In addition, film cleaning apparatus 24 also includes a nuclear ionizing source 62 which is mounted on the back wall of apparatus 24 and ionizes the air along the path of film segments 12 and paper tab 14. The ionized air tends to neutralize static electrical charges on film segments 12, thereby preventing additional dust from collecting on the surfaces of film segments 12 after cleaning, but before printing at neghold station 26.

As illustrated in FIG. 1, film segments 12 may assume a variety of different positions, since only one edge of each segment is attached to paper tab 14. Depending upon the tension in the tab and the natural curl of the film segments 12, the unattached edge of each segment 12 may be in the same plane as tab 14, may be above the plane of tab 14, or may be below the plane of tab 14. Film guiding assembly 32 guides film segments 12 and tab 14 reliably into the nip defined by tubular members 46 and 48 and wiping cloths 50 and 56 and prevents the free edges of film segments 12 from jamming against either upper tubular member 46 or lower tubular member 48.

Figure 5:
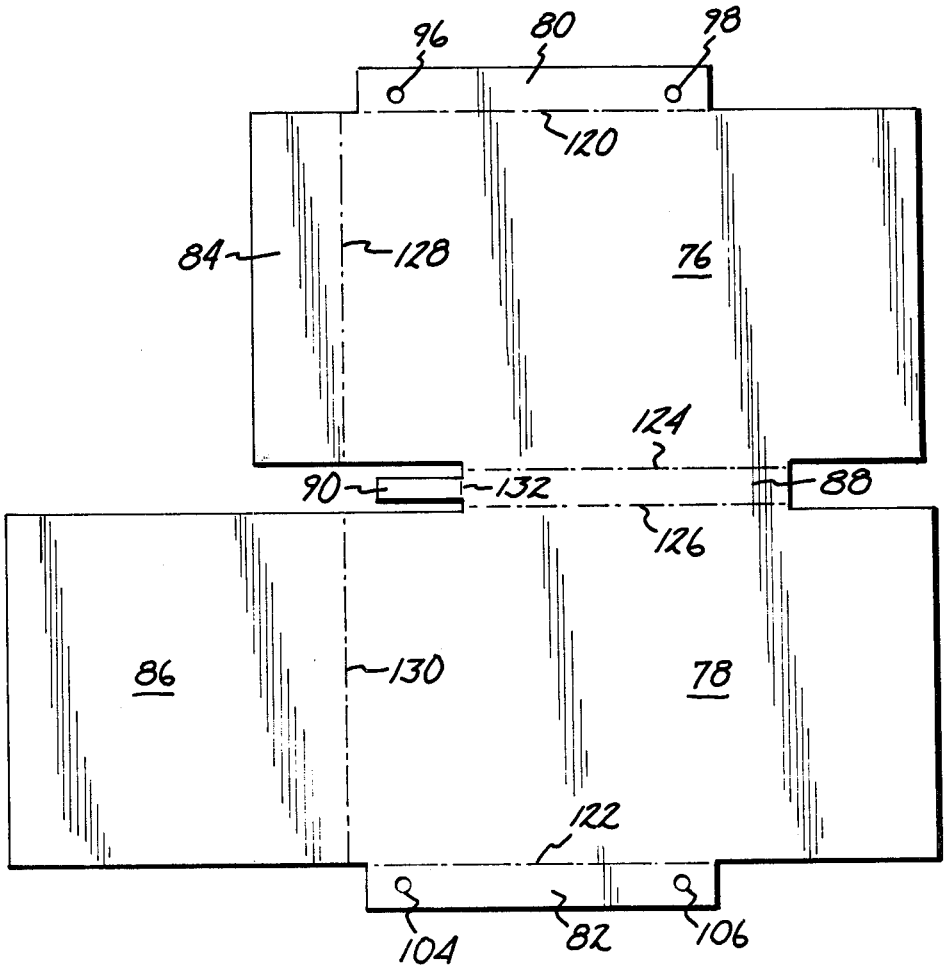
FIG. 5 is a top view of a metal sheet used to form the film guide of the present invention, prior to bending.
Figure 3:
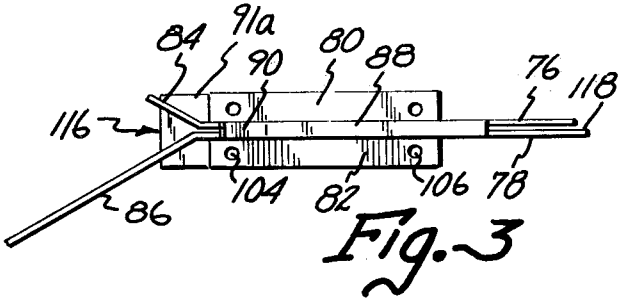
FIG. 3 is a front view of the film guide of the present invention.
Figure 2:
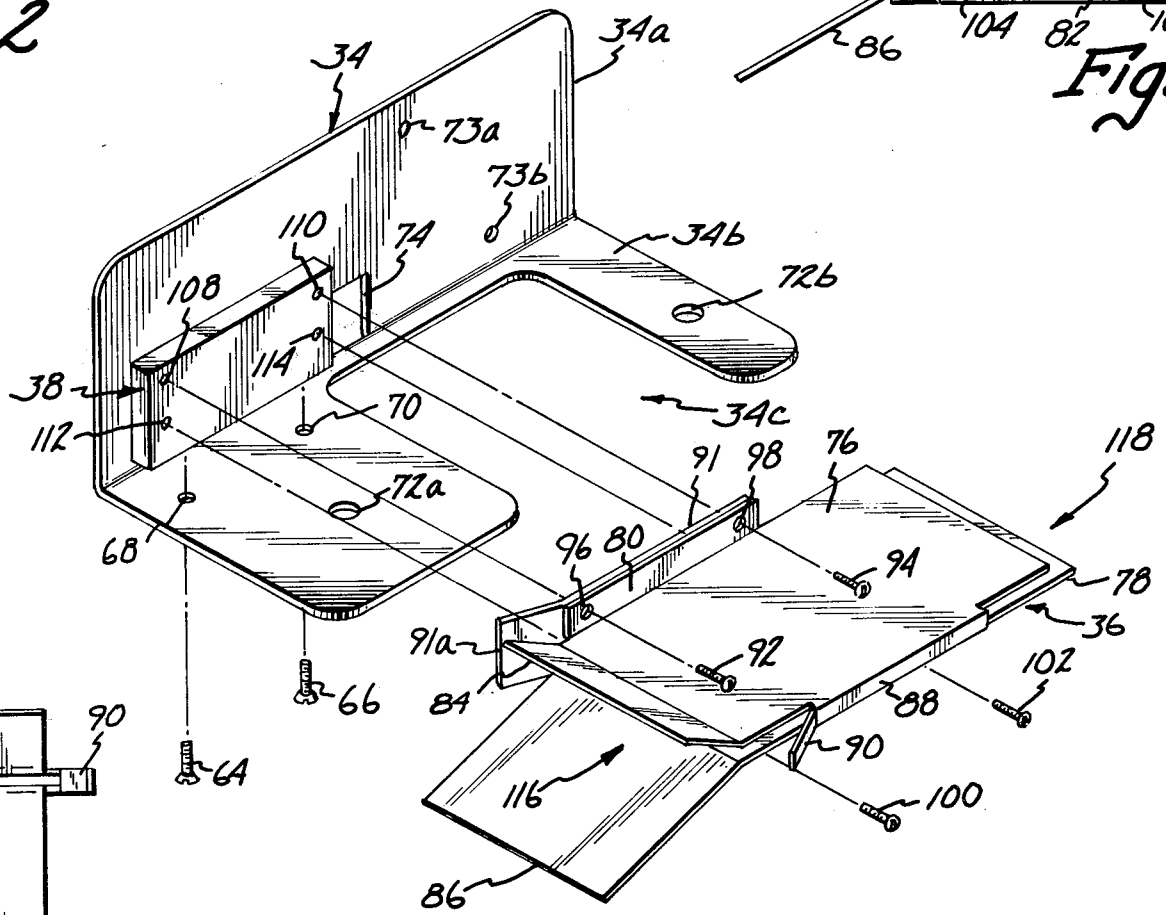
FIG. 2 is an exploded view of the film guide of the present invention.
Figure 4:
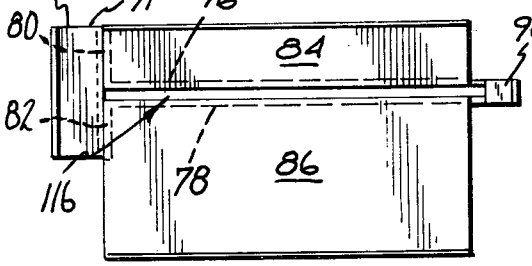
FIG. 4 is an end view of the film guide of the present invention.

FIGS. 2–5 show the film guiding device of the present invention in further detail. FIG. 2 is an exploded view showing bracket 34, guide 36, and mounting block 38. FIGS. 3 and 4 show front and end views of guide 36, while FIG. 5 is a top view illustrating the fabrication of guide 36 from a single piece of sheet metal.

As shown in FIG. 2, mounting bracket 34 has an upstanding portion 34*a* and a generally horizontal base portion 34*b*. Base portion 34*b* has an opening 34*c* through which film cleaning apparatus 24 extends. Mounting block 38 is mounted to base 34*b* by screws 64 and 66, which extend through holes 68 and 70, respectively in base 34 and into corresponding holes in the bottom surface of mounting block 38. Base portion 34*b* also includes mounting holes 72*a* and 72*b* through which mounting screws 42 and 44, respectively, extend to mount bracket 34 to top surface 40 of printer 10.

In upstanding portion 34*a* mounting holes 73*a* and 73*b* (as well as a third mounting hole which is obscured by block 38 in FIG. 2) permit connection of mounting bracket 34 and film cleaning apparatus 24 by mounting screws (not shown). In addition, aperture 74 is provided in upstanding portion 34*a* to permit the electrical cord of film cleaning apparatus 24 to be connected to a source of electrical power.

As shown in FIGS. 2–5, guide 36 preferably includes a unitary sheet metal body which forms top plate 76, bottom plate 78, upturned vertical mounting flange 80, downturned vertical mounting flange 82, upper inclined deflector 84, lower inclined deflector 86, vertical guiding wall 88, and horizontal deflector 90. Mounted across flanges 80 and 82 is metal plate 91 which is preferably spot-welded to flanges 80 and 82. Plate 91 has an out-turned portion 91 which forms a horizontal or transverse deflector similar to horizontal deflector 90. Guide 36 is attached to mounting block 38 by mounting screws 92 and 94 which extend through holes 96 and 98, respectively, in upper flange 80 and plate 91, and by mounting screws 100 and 102, which extend through mounting holes 104 and 106, respectively, in lower mounting flange 82 and plate 91. Screws 92, 94, 100 and 102 extend into holes 108, 110, 112 and 114, respectively, in mounting block 38.

Top and bottom plates 76 and 78 of guide 36 are generally parallel to one another, and are closely spaced to define a guide path for tab 14 and film segments 12. The guide path defined by plates 76 and 78 has an inlet end 116 at which film segments 12 and tab 14 enter the guide path and an outlet end 118 at which film segments 12 and tab 14 leave the guide path. In the preferred embodiments of the present invention, guide 36 is mounted in fixed position with respect to film cleaning apparatus 24 so that outlet end 118 is very closely spaced to the nip defined by tubular members 46 and 48 and wiping cloths 50 and 56. Plates 76 and 78 provide positive control over segments 12 to maintain segments 12 substantially in the same plane as tab 14. This prevents the free edges of segments 12 from jamming against either upper tubular member 46 or lower tubular member 48 of film cleaning apparatus 24.

Upper inclined deflector 84 which extends forward and above top plate 76, deflects the free edges of any segments 12 which are above inlet end 116 gradually downward and into inlet end 116. Similarly, lower inclined deflector 86, which extends forward and below bottom plate 78, deflects any free edges of segments 12 gradually upward and into inlet end 116.

In the preferred embodiments shown in the Figures, guide 36 also includes a vertical side wall 88 which extends between and defines the spacing of top and bottom plates 76 and 78. Vertical side wall 88 also provides a guiding edge for the front edge of tab 14. In the embodiments shown in the Figures film segments 12 are connected to tab 14 along the rear edge of tab 14. Vertical wall 88 provides a guiding surface for the front edge of tab 14, and therefore for the attached film segments 12, as they pass through guide 36 and into film cleaning apparatus 24.

As tab 14 and film segments 12 are advanced, some slight transverse misalignment can occur. For that reason, horizontal or transverse deflector 90 is attached to the upstream end of wall 88 and extends forwardly and outwardly. Deflector 90 gradually deflects the front edge of tab 14 to the guiding surface defined by vertical wall 88. Similarly, deflector portion 91*a* of plate 91 acts as a transverse deflector on the opposite side of inlet 116 from deflector 90.

An important advantage of guide 36, as shown in FIGS. 1–5, is that a single piece of sheet metal forms nearly all of guide 36 (except plate 91), thereby greatly reducing manufacturing costs. FIG. 5 is a top view showing guide 36 prior to folding. The locations of folds are designated by dashed lines 120, 122, 124, 126, 128, 130 and 132. After the folds are made, plate 91 is attached to flanges 80 and 82 such as by spot-welding. The attachment of plate 91 to flanges 80 and 82 defines the spacing between plates 76 and 78 on the side opposite vertical wall 88.

In conclusion, the film guide of the present invention permits conventional film cleaning apparatus to be used both for first-run production and for reprint production by providing consistent and trouble-free guiding of tabbed film segments into the film cleaning apparatus. As a result, a separate, special film cleaning device need not be provided for reprint systems. The film guide of the present invention may be left in place even after first-run production since it also provides desirable guiding of the spliced-together film strips into the film cleaner.

Although the present invention has been described with reference to preferred embodiments, workers skilled in the art will recognize that changes may be made in form and detail without departing from the spirit and scope of the invention.

What is claimed is:

1. For use with photographic film cleaning apparatus for cleaning photographic film transported along a path, the film cleaning apparatus being of the type having support members in opposed relationship to define a nip therebetween, the nip being disposed transverse to the path, and two lengths of soft, lint-free wiping cloth extending through the nip, the opposed surfaces of cloth at the nip defining part of the path; film guide means comprising:

first and second generally parallel, closely spaced guide plates with opposing surfaces defining an opening which is part of the path, the opening having an inlet and an outlet, and wherein the first and second guide plates are in fixed position with respect to the film cleaning apparatus with the outlet of the opening proximate the nip;

a guide wall between the first and second guide plates and essentially parallel to the path;

a first transverse guiding member extending forward and outward from the guide wall for deflecting the film toward the path;

a first member forward and above the inlet for guiding the film downward toward the inlet; and a second member forward and below the inlet for guiding the film upward toward the inlet.

2. The invention of claim 1 wherein the first member comprises a first inclined member having a first free end positioned forward and above the inlet and a second end positioned proximate the inlet.

3. The invention of claim 2 wherein the second member comprises a second inclined member having a first free end positioned forward and below the inlet and a second end positioned proximate the inlet.

4. The invention of claim 3 wherein the first inclined member has its second end connected to the first guide plate and wherein the second inclined member has its second end connected to the second guide plate.

5. The invention of claim 1 wherein the guide wall connects the first and second guide plates.

6. The invention of claim 5 wherein the first member comprises a first inclined member having a first free end positioned forward and above the inlet and a second end connected to the first guide plate, and wherein the second member comprises a second inclined member having a first free end positioned forward and below the inlet and a second end connected to the second guide plate.

7. The invention of claim 6 and further comprising:

a second transverse guiding member positioned on an opposite side of the inlet from the first transverse guiding member.

8. The invention of claim 7 wherein the first and second guide plates, the guide wall, the first transverse guiding member, and the first and second inclined members comprise a unitary sheet metal body.

9. The invention of claim 8 and further comprising:

a first up-turned flange member connected to one edge of the first guide plate; and a second down-turned flange connected to one edge of the second guide plate.

10. The invention of claim 9 and further comprising:

a connecting plate member connected between the first and second flange members, and wherein the second transverse guiding member is connected to the connecting plate member.

11. The invention of claims 1 or 9 and further comprising:

a mounting bracket connected to the film cleaning apparatus; and mounting means for mounting the first and second guide plates to the mounting bracket with the outlet of the opening proximate the nip.

12. The invention of claim 11 wherein the mounting means comprises:

a mounting block mounted to the mounting bracket; and connecting means for connecting the guide plates to the mounting block.

13. A film guide for guiding photographic film segments attached to an elongated tab, the film guide comprising:

first and second generally parallel, closely spaced guide plates with opposing surfaces defining an opening through which the elongated tab with attached film segments passes, the opposing surfaces causing the film segments and elongated tab to lie in a substantially common plane, and wherein the opening has an inlet and an outlet;

a guide wall between the first and second guide plates for defining a longitudinal guiding surface for one edge of the tab;

a first transverse guiding member extending forward and outward from the guide wall for deflecting the tab toward the guide wall;

a first member forward and above the inlet for guiding the film segments and elongated tab downward toward the inlet; and a second member forward and below the inlet for guiding the film segments and elongated tab upward toward the inlet.

14. The invention of claim 13 wherein the guide wall connects the first and second guide plates.

15. The invention of claim 13 or 18 wherein the first member comprises a first inclined member having a first free end positioned forward and above the inlet and a second end connected to the first guide plate, and wherein the second member comprises a second inclined member having a first free end positioned forward and below the inlet and a second end connected to the second guide plate.

16. The invention of claim 15 wherein the first and second guide plates, the guide wall, the first transverse guiding member, and the first and second inclined members comprise a unitary sheet metal body.

17. The invention of claim 16 and further comprising:

a first up-turned mounting flange member connected to one edge of the first guide plate; and a second down-turned mounting flange member connected to one edge of the second guide plate.

18. The invention of claim 15 and further comprising:

a second transverse guiding member positioned on an opposite side of the inlet from the first transverse guiding member.

* * * * *